US007491354B2

(12) United States Patent
Andersen

(10) Patent No.: US 7,491,354 B2
(45) Date of Patent: Feb. 17, 2009

(54) FIBER DISTRIBUTION DEVICE FOR DRY FORMING A FIBROUS PRODUCT AND METHOD

(75) Inventor: Carsten Andersen, Hasselager (DK)

(73) Assignee: Formfiber Denmark APS (DK)

( * ) Notice: Subject to any disclaimer, the term of this patent is extended or adjusted under 35 U.S.C. 154(b) by 664 days.

(21) Appl. No.: 10/982,257

(22) Filed: Nov. 5, 2004

(65) Prior Publication Data

US 2005/0098910 A1 May 12, 2005

(30) Foreign Application Priority Data

Nov. 7, 2003 (DK) ..... 2003 01655

(51) Int. Cl.
*B27N 3/04* (2006.01)

(52) U.S. Cl. ..... 264/115; 264/518; 264/121; 425/82.1; 425/83.1

(58) Field of Classification Search ..... None
See application file for complete search history.

(56) References Cited

U.S. PATENT DOCUMENTS

| | | | | |
|---|---|---|---|---|
| 3,644,078 | A | 2/1972 | Tachibana et al. | |
| 3,843,756 | A * | 10/1974 | Talbott et al. | 264/441 |
| 4,332,756 | A | 6/1982 | Bean et al. | |
| 4,640,810 | A * | 2/1987 | Laursen et al. | 264/518 |
| 4,650,409 | A * | 3/1987 | Nistri et al. | 425/82.1 |
| 6,233,787 | B1 | 5/2001 | Eriksen et al. | |
| 6,627,131 | B2 * | 9/2003 | Huber | 264/122 |
| 6,997,692 | B2 * | 2/2006 | Pearson | 425/83.1 |
| 2003/0116890 | A1 * | 6/2003 | Chambers et al. | 264/518 |
| 2003/0127763 | A1 * | 7/2003 | Stutz | 264/40.4 |

FOREIGN PATENT DOCUMENTS

| | | |
|---|---|---|
| EP | 0 159 618 | 10/1985 |
| GB | 2 141 150 | 12/1984 |

* cited by examiner

*Primary Examiner*—Mary Lynn F Theisen
(74) *Attorney, Agent, or Firm*—Cantor Colburn LLP

(57) ABSTRACT

A forming box for use in dry forming of a mat of fibrous material, and a forming method. The forming box comprises a housing with an open bottom providing direct access for fibers onto an underlying forming wire and a vacuum box underneath said forming wire; an inlet for supplying fiber material into the inside of the housing; and a number of fiber separating rollers in one or more rows in the housing between the fiber inlet and the housing bottom. An endless belt screen is provided inside the housing having an upper run between two rows of spike rollers and a lower run closer to the open bottom of the forming box. Fiber clumps captured on the lower run of the belt screen are conveyed above fiber separating rollers and are released from the upper run of the belt screen into contact with the fiber separating rollers.

28 Claims, 6 Drawing Sheets

FIBER DISTRIBUTION DEVICE FOR DRY FORMING A FIBROUS PRODUCT AND METHOD

FIELD OF THE INVENTION

The present invention relates to a forming box for use in dry forming of a mat of fibrous material, and a dry forming method.

BACKGROUND OF THE INVENTION

A forming box of the type described in EP 0 159 618 A1 is most often an integral part of the entire papermaking plant, and constitutes an essential limitation to the capacity of the plant.

Fibers are blown into a forming box, where they are distributed onto an underlying forming wire. A vacuum box is provided underneath the forming wire for drawing the fibers onto the forming wire. For placing the fibers on the forming wire, the forming box is provided with a bottom net or sieve having a number of openings. In order to ensure the passage of the fibers through the bottom of the forming box it is suggested to use wings, rollers or other scraping or brushing devices, which in an active manner removes fibers from the sieve at the bottom of the forming box. Although such mechanical devices do give an increase in manufacturing capacity, attempts have been made for many years to increase the capacity further.

The size of the openings in the mesh or sieve at the bottom of the forming box depends upon the characteristics of the fibers which are to be distributed on the forming wire. This is particularly relevant in relation to the use of cellulose fibers in the manufacture of paper products including absorbing products, such as napkins. Thus, there has been a limitation in the length of the fibers used. In practice, it is found that it is generally not possible to use fibers with a length of more than about 18 mm. This also limits the kind of non-woven products that can be thus manufactured.

U.S. Pat. No. 6,233,787 B1 describes a forming box with an open bottom, i.e. without a bottom mesh or sieve. The distribution of fibers is carried out by a number of rotating spike rollers in the forming box, the spikes being arranged to partly hold back the fibers against the effect of the aid stream resulting from the suction of the underlying vacuum box. The cloud of fibers which is formed inside the forming box of single fibers, which are mixed in the air stream, are transferred down onto the underlying wire by the application of the rotating spike rollers. This increases the capacity of the forming apparatus.

However, clumps of fibers may pass the spike rollers without being tom sufficiently apart by the spikes. This results in an uneven distribution of fibers on the forming wire. It would be desirable to provide a fiber distributor which encourages an even distribution of fibers on the forming wire in a dry-forming apparatus without compromising the capacity of the fiber distributor. In addition, it is the object to provide a fiber distributor which is reliable in operation and which allows for longer time between overhauls or maintenance.

SUMMARY OF THE INVENTION

The present invention utilizes a forming box wherein an endless belt screen is provided having an upper run along at least one row of spike rollers and a lower run closer to the open bottom of the forming box.

In one embodiment, the invention relates to a forming box for use in dry forming of a mat of fibrous material, the forming box comprising:

- a housing with an open bottom for providing direct access for the fibers onto an underlying forming wire and a vacuum box underneath said forming wire;
- at least one inlet for supplying fiber material into the inside of the housing;
- a number of spike rollers in at least one row in the housing between the fiber inlet and the housing bottom; and
- an endless belt screen having an upper run adjacent the at least one row of spike rollers and a lower run closer to the open bottom of the forming box.

In another embodiment, the invention pertains to a method for dry forming a mat of fibrous material, comprising

- charging fibrous material into a forming box having an open bottom positioned over a forming wire to form a mat of fibers on the forming wire, the forming box having a plurality of fiber separating rollers for breaking apart clumps of fibers;
- capturing clumps of fibers on a lower run of an endless belt beneath fiber-separating rollers and above the forming wire; and
- conveying captured clumps of fibers on the endless belt above fiber-separating rollers in an upper run to enable captured clumps to release from the belt and to contact and be broken apart by the rollers.

DETAILED DESCRIPTION

Figure 1:
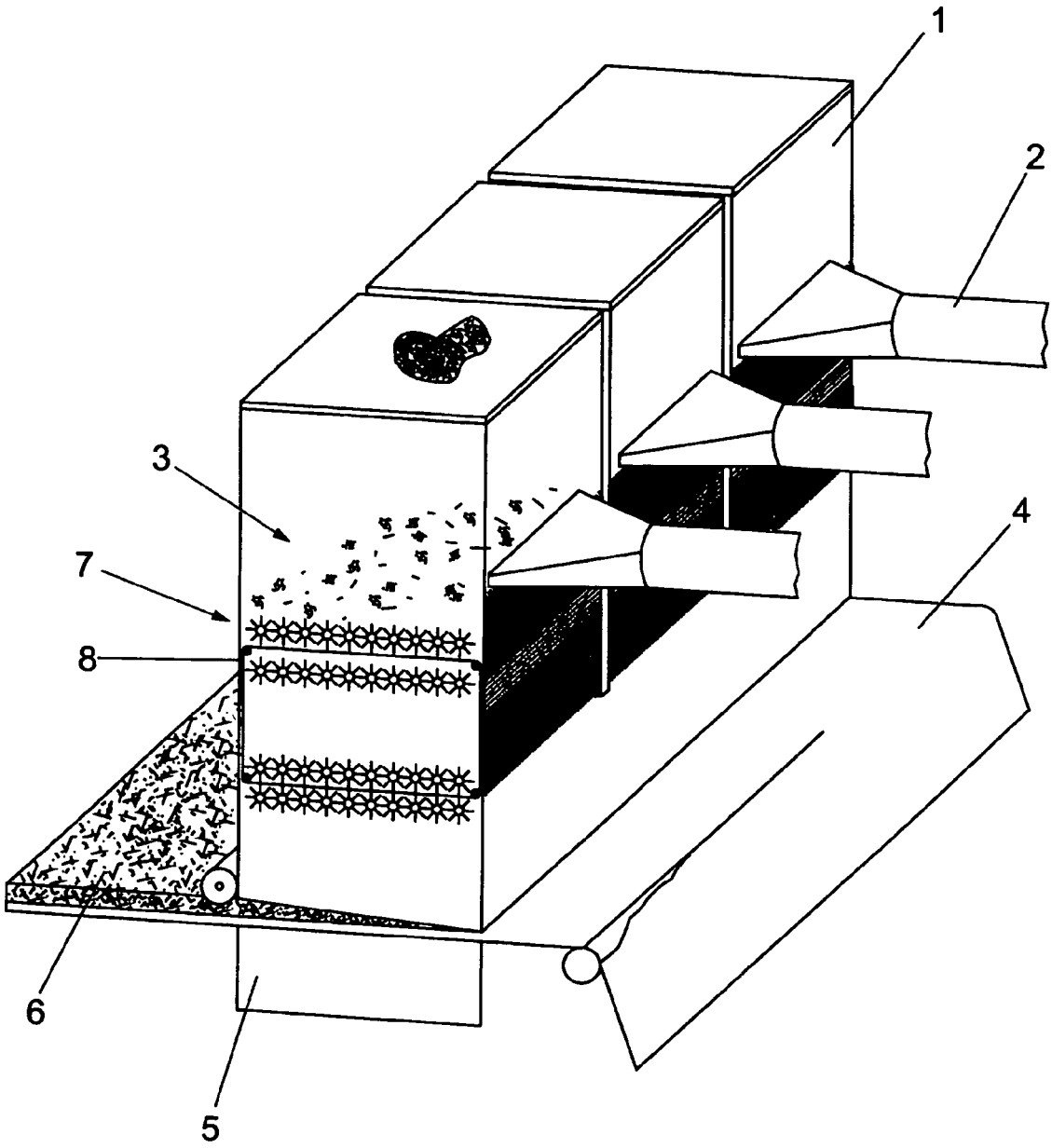
FIG. 1 is a schematic perspective view of a forming box according to one embodiment of the invention.

Use of a forming box according to the invention enables an efficient disintegration of fibers to be achieved and an even distribution of fibers on the forming wire to be obtained by the forming box without reducing the capacity of the fiber distributor. The "forming wire", as used herein, refers to endless wire screens or other web-like materials of the type used in the paper making industry. An endless belt screen has an upper run, which runs immediately below and/or above a row of spike rollers i.e. for instance between two rows of spike rollers and a lower run in the lower part of the forming box. This promotes an even distribution of the fibers as fiber clumps or oversized fibers are prevented from being laid down on the forming wire but are instead retained on the belt screen in the forming box and transported away from the lower portion of the forming box and returned to the spike rollers for further disintegration. In a forming box according to the invention, the endless belt screen provides a sieve or fiber screen member which is self-cleaning since the oversized fibers are retained on one upper side of the lower run of the endless belt screen and released from lower side of the upper run of the endless belt screen because of the vacuum underneath the forming box and the forming wire.

The fiber-separating rollers employed herein are rollers having outer configurations adapted to separate clumps of fibers. Rollers for this purpose may have radially outward projecting fingers or spikes for contacting the fiber clumps, and these are often referred to herein as "spike rollers".

In a preferred embodiment, two rows of spike rollers are provided on each side of the upper run of the belt screen, enabling an initial disintegration of the supplied fibers to be provided before the screening by the belt screen, and a further disintegration after this first screening.

Preferably, the spike rollers in the row immediately below the upper run of the belt screen are positioned with a decreasing distance between their axis of rotation and the belt screen in the direction of travel of the upper run of the belt screen. In this manner, the fiber clumps or clusters of fibers retained on the lower run of the belt screen are encountered by the spike rollers and separated or disintegrated in a graduated fashion as these retained fibers are returned by the upper part of the belt screen for reprocessing. By starting with a "course" processing of the returned fibers as these fiber first encounter the spike rollers, and then gradually reducing the gap between the belt screen and the individual spike rollers, the forming box promotes disintegration of clumps of returned fibers and largely avoids the possibility that clumps of fibers are compressed and drawn through a gap between two adjacent spike rollers. Hence, improved fiber clump disintegration is achieved.

In order to achieve further disintegration of the fibers and thereby promote more even distribution, two further rows of spike rollers may be provided on each side of the lower run of the belt screen.

In one embodiment of the invention, spike rollers are provided along at least one of the vertically runs of the belt screen to enable fibers that are drawn along the belt screen to be re-processed also during the return path and/or to enable the belt screen to be cleaned by the spike rollers provided along the vertical path of the belt screen.

In an embodiment of the invention, the belt screen extends beyond the forming box housing in the downstream direction of movement of the forming wire, enabling an extra cleaning effect of the belt screen to be achieved without interfering with the forming process depending on the type of fibers used. This may be advantageous with respect to some types of products. Alternatively, the belt screen is provided entirely inside the housing.

The fibers of the fiber material may be natural fibers, such as cellulose fibers, synthetic fibers or any combination thereof as well as granular material in any kind possible.

The belt screen may be driven with the same or in the opposite direction of movement of the lower run as the underlying forming wire, permitting different laying formation of the fibers to be achieved for forming a fibrous mat with a particular desired surface pattern. Moreover, the belt screen may be either continuously driven, e.g. with a constant speed, or intermittently driven. These different modes of operation of the forming box also allow for different fiber formation patterns on the forming wire.

In an embodiment of the invention, two further rows of spike rollers may be provided on each side of the lower run of the belt screen to allow for additional disintegration of fibers or clumps of fibers.

The belt screen is preferably provided with grid openings in a predetermined pattern. In one embodiment, for example, the belt screen may be a wire mesh having a predetermined mesh opening. In another embodiment, the belt screen has transversely orientated grid members with openings in between them.

In one embodiment, the lower run of the belt screen is immediately above the forming wire so that the belt screen makes contact with the upper side of the fiber formation being air laid on the forming wire. In this manner, the vacuum is screened in some areas in the bottom opening of the forming box, and a predetermined surface structure of the laid product may be achieved. These vacuum screened areas are determined by the screen pattern of the belt screen.

Figure 2:
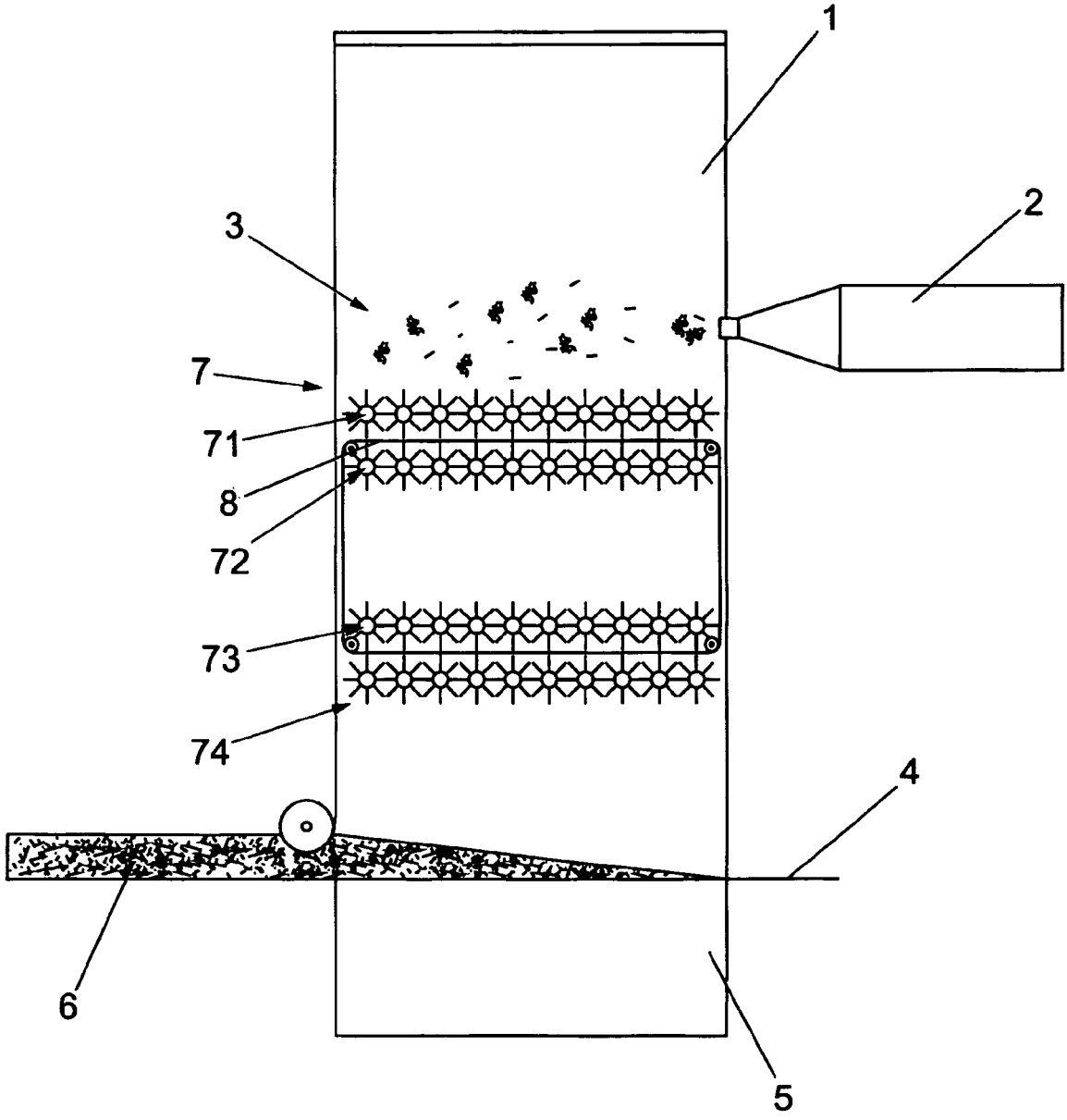
FIG. 2 is a schematic side view of a forming box according to a first embodiment of the invention.

The invention may be more fully understood by reference to the accompanying drawings. In FIGS. 1 and 2, a forming box according to a first embodiment of the invention is shown. The forming box comprises a housing 1 into which fibers 3 are supplied from an inlet 2. A vacuum box 5 is positioned beneath a forming wire 4, and the forming box is positioned above the wire. Fibers 3 are air laid on the forming wire 4 to form a fiberboard 6 in a dry forming process. In FIG. 1, the forming box is shown with the interior elements visible in the housing. However, it is realized that the housing walls may be made either from transparent or opaque materials.

The fiberboard 6 may be made from or at least include natural fibers, such as cellulose fibers, animal hair, fibers from flax, hemp, jute, ramie, sisal, cotton, kapok, glass, stone, old newsprint, elephant grass, sphagnum, seaweed, palm fibers or the like. These fibers have a certain insulating capacity that may be useful in many applications. The fiberboard 6 may also be made from or at least include a portion of synthetic fibers, such as polyamide, polyester, polyacrylic, polypropylene, bi-component or vermiculite fibers or the like as well as any kind of granular material. Fiberboards with such synthetic fibers may be used for providing the fiber product with certain properties, e.g. absorbent products. Moreover, the fibers may be pre-treated with a fire retardant or a fire retardant may be supplied directly in the fiber mixture which is blown into the forming box.

Figure 3:
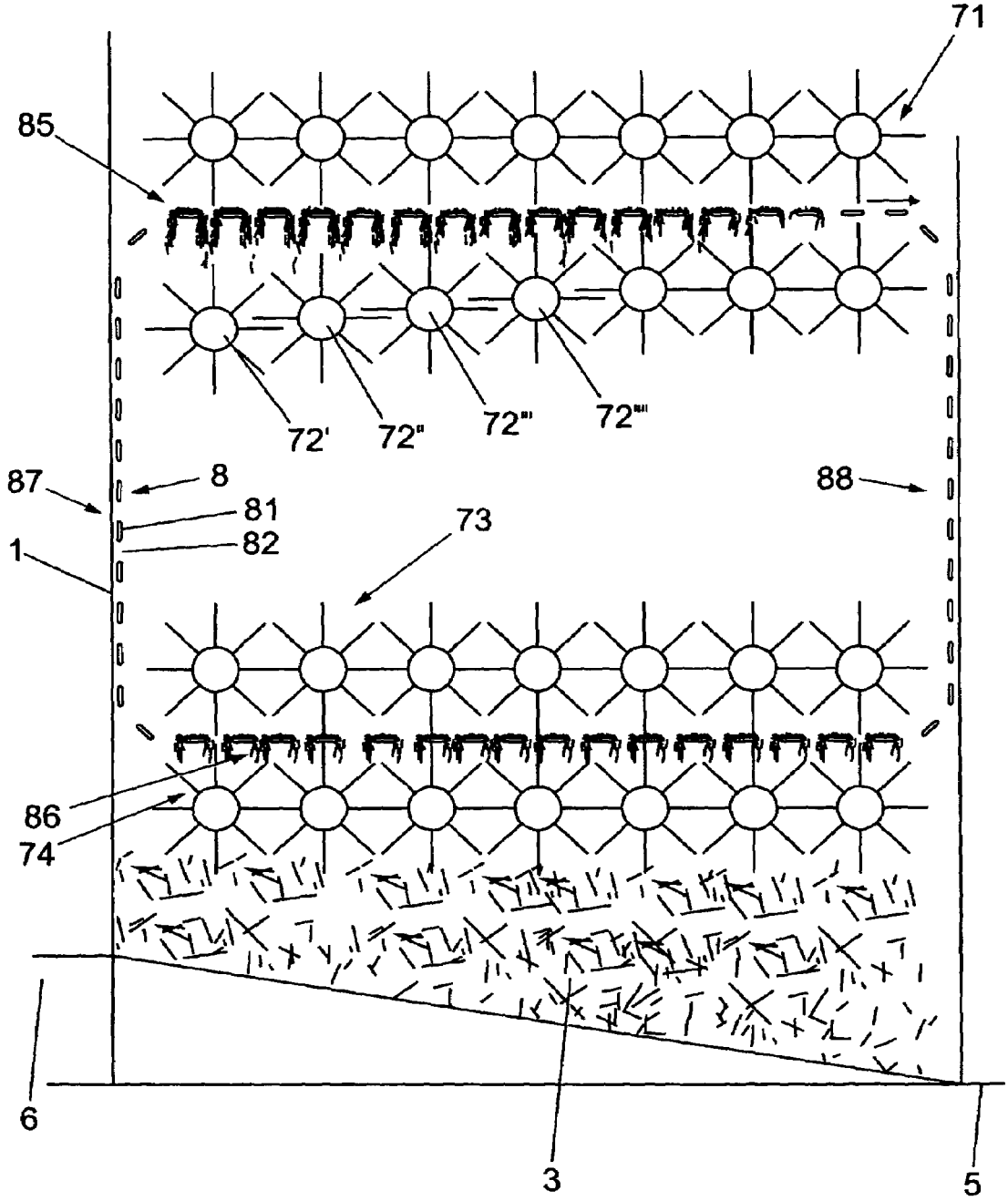
FIG. 3 is a detailed view of the forming box shown in FIG. 2.

The fibers 3 are blown into the housing 1 of the forming box via the inlet 2. Inside the forming box a number of spike rollers 7 are provided in one or more rows, e.g. four rows of spike rollers 71, 72, 73, 74 as are shown in FIGS. 1 and 2. In the housing, an endless belt screen 8 is also provided. This endless belt screen 8 is provided with a conveying path including an upper run 85, a vertical section 88 where the belt screen 8 moves in a downwards direction, a lower run 86 where the belt screen 8 travels substantially parallel with the underlying forming wire 5 and an upwardly oriented run 87, as shown in FIG. 3. Although the direction of travel of the belt screen with respect to the forming wire may be changed, it is generally preferred that the lower run of the belt screen move in the same direction as the forming wire. In FIGS. 2 through 5, the belt screen moves in a clockwise direction; that is, the lower run of the belt screen and the forming wire both move toward the left in these figures.

Adjacent the upper run 85 of the belt screen 8, at least one row of spike rollers 71 is provided. In the embodiment shown, two upper rows of spike rollers 71, 72 and two lower rows of spike rollers 73, 74 are provided at different levels in the housing 1. The belt screen is arranged with an upper run path 85 between the two upper rows of spike rollers 71, 72 and the lower run path 86 between the lower rows of spike rollers 73, 74.

The fibers 3 supplied into the housing 1 may include fiber clumps. The spike rollers 7 disintegrate or shred the clumps of fibers 3 in order to ensure an even distribution of fibers 3 in the product 6 formed on the forming wire 5. The fibers pass the spike rollers 71 in the first row and then the belt screen 8 and the second row of spike rollers 72 as the fibers are sucked downwards in the forming box. In the lower run 86 of the belt screen 8, oversized fibers and fiber clumps are retained on the belt screen 8 and returned to the upper section of the forming box for further disintegration. The retained fibers are captured on the upper surface of the lower run 86 of the belt screen 8, which then becomes the lower surface of the upper run 85; the fibers are sucked downward from the belt screen 8 and the clumps of fibers are shredded by the spike rollers an additional time.

As shown in FIG. 3, the row of spike rollers 72 immediately below the upper run 85 of the belt screen 8 may be inclined with respect to the upper run 85. This row 72 receives the retained, "oversized" fibers and fiber clumps that were retained on the lower run. In order to ensure that the fibers 3 are shredded efficiently in this row 72, the first spike rollers 72', 72", 72''', 72''''in the row 72 are provided with different, decreasing distances between their respective axes of rotation and the upper run 85 of the belt screen 8. The first spike roller 72' in the row is positioned with the largest distance and the subsequent spike rollers 72", 72''' and 72'''' are positioned with graduated closer distances, so that fibers in the clumps of returned, oversized fibers are "peeled" off gently to enable them to be shredded and disintegrated rather than being sucked and dragged off the belt screen between two adjacent spike rollers without undergoing shredding.

The endless belt screen 8 includes closed portions 81 and openings 82 provided in a predetermined pattern. Alternatively, the belt screen 8 may be a wire mesh. By a particular pattern of openings 82 and closures 81 of the belt screen 8, a predetermined surface pattern on the fiberboard 6 may be achieved by arranging the lower run 86 of the belt screen 8 so that it makes contact with the top surface of the fibers which are laid on the forming wire 4, as shown in FIG. 4.

Figure 5:
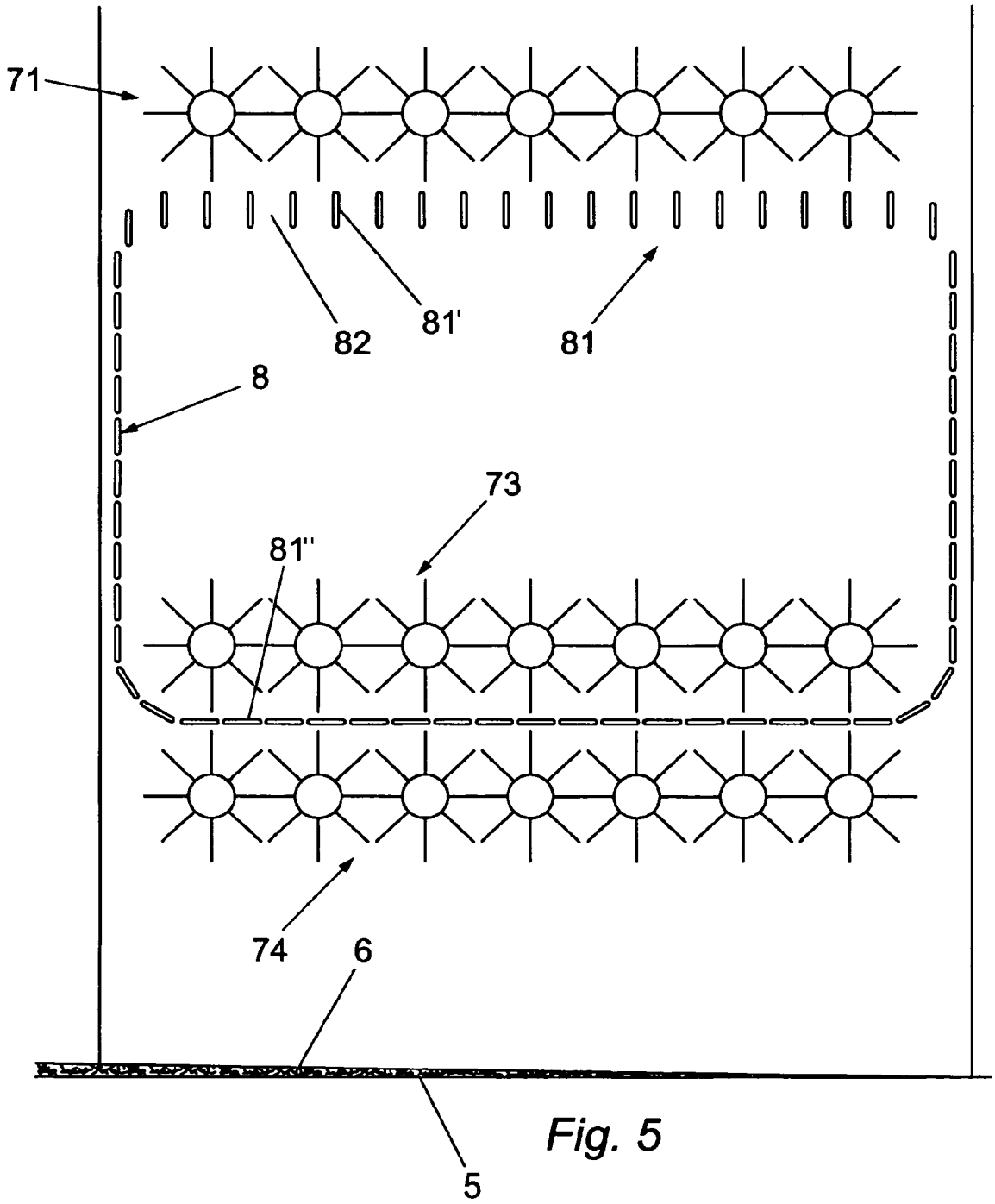
FIG. 5 is a detailed side view of yet another embodiment of the invention.

In FIG. 5, another embodiment of a belt screen 8 in the forming box is shown. According to this embodiment, the belt screen 8 is made from pivotable elements 81 retaining the fibers. By pivoting the elements 81 between an open position 81' and a closed/flat position 81", employing simple mechanical control of the pivoting elements, the opening between the elements may be changed. A "course" sieve function may be obtained on the upper run path of the belt screen 8 where the pivoting elements are in their open positions, and a "fine" sieve may be obtained on the bottom run path where the pivoting elements are in their closed positions.

Figure 4:
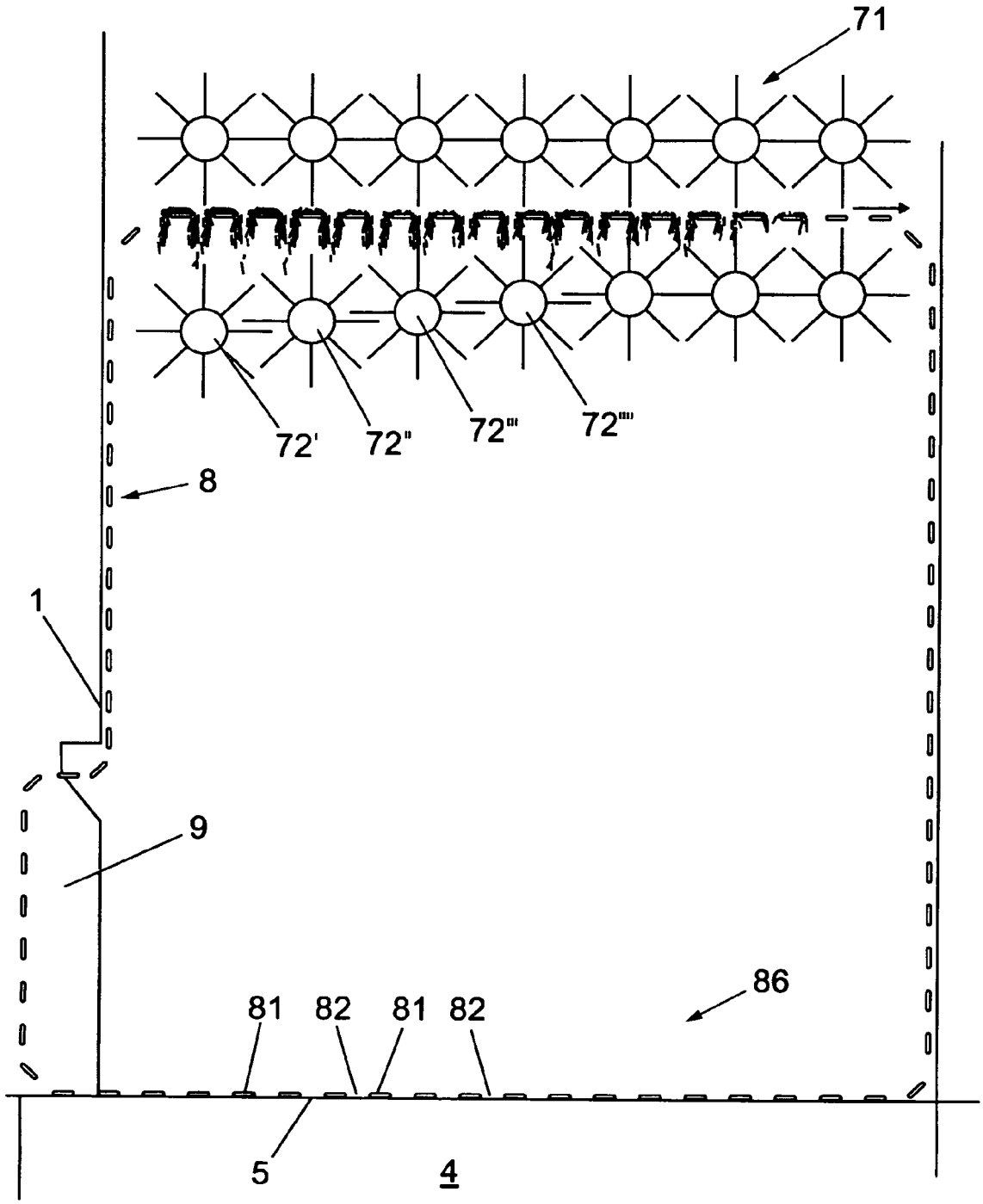
FIG. 4 is a detailed view of another embodiment of a forming box according to the invention.

As shown in FIG. 4, the belt screen 8 may be guided along a path taking it outside the housing 1, enabling an exterior cleaning means 9, e.g., an air blower or the like, to be installed outside the housing for cleaning the belt screen without interrupting the forming process. The vacuum box may be extended in the downstream direction beyond the forming box to permit loose fibers to be laid in a finishing layer on the top surface of the formed fiberboard.

In the vertically oriented paths of travel 87, 88, one or more spike rollers (not shown) may be provided adjacent the belt screen 8 for loosening fibers on the belt screen. The configuration of the spike rollers may be chosen in accordance with the kinds of fibers which are to be air-laid by the forming box.

Figure 6:
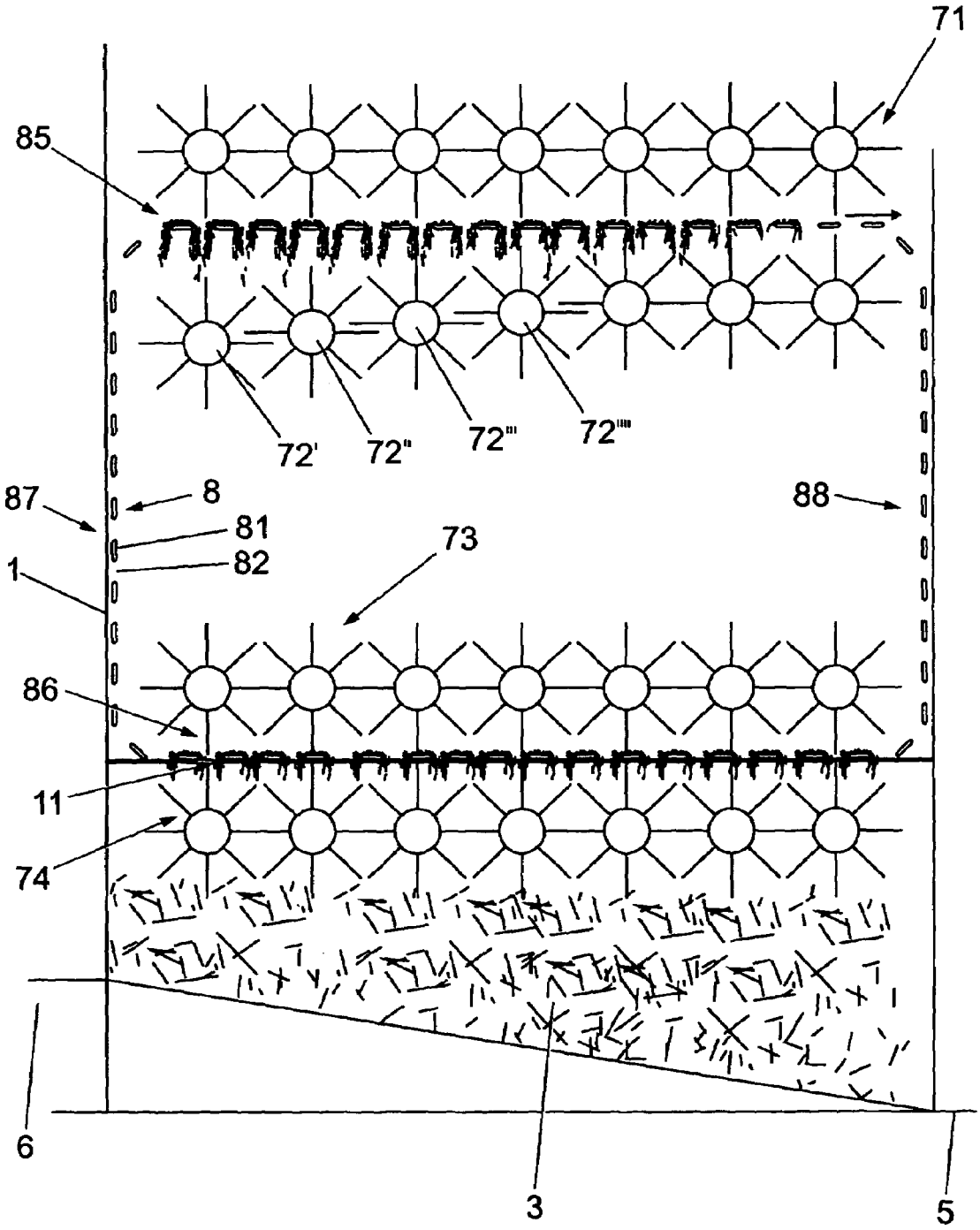
FIG. 6 is another embodiment of the forming box, shown in FIG. 3.

The bottom of the forming box may be provided with a sieve 11 as shown in FIG. 6, and the belt screen 8 may accordingly be provided with brush means (not shown) for removing retained fibers. In this manner, the belt may additionally be used for cleaning a bottom sieve. The brush means may be members provided for sweeping the fibers off the upper side of the lower run path of the belt screen. Alternatively or in combination, the belt screen may be provided with means for generating a turbulent airflow stirring up the retained fibers on the sieve. In this manner, a forming box with a bottom sieve may be provided with a cleaning facility for the bottom sieve and the belt may additionally be used for preventing that the sieve is clogging up.

In the above-described embodiments, the inlet is shown positioned above the belt screen and the spike rollers. However, it is realized that the inlet may be positioned below the upper run of the belt screen, and/or that a plurality of inlets may be provided, e.g. for supplying different types of fibers to the forming box. The spike rollers and indeed the belt screen will then assist in mixing the fibers inside the forming box.

In another embodiment, a granulate or another type of fiber may be supplied into the forming box above the fiber inlet 2 and mixed with the fibers adjacent the inlet opening inside the forming box. Such granulate is supplied separately to the forming box since it must be transported at a separate (higher) airflow velocity. Granulate materials may include vermiculite, rubber, plastic, glass fiber, rock wool, etc. The granulate may also include metal fibers, such as aluminum or brass, steel, etc.

The present invention is described above with reference to some preferred embodiments. However, it is realized that many variants and equivalents may be provided without departing from the scope of the invention, as defined in the accompanying claims.

The invention claimed is:

1. A forming box for use in dry forming of a mat of fibrous material, said forming box comprising:

a housing with an open bottom for providing direct access for the fibers onto an underlying forming wire and a vacuum box underneath said forming wire;

at least one inlet for supplying fiber material into the inside of the housing;

fiber-separating rollers positioned in the housing between the fiber inlet and the housing bottom; and an endless belt screen having an upper run adjacent said rollers and a lower run closer to the open bottom of the forming box.

2. A forming box according to claim 1, wherein the belt screen is driven with the same direction of movement of its lower run as the underlying forming wire.

3. A forming box according to claim 1 including a belt screen driver for continuously driving the belt screen.

4. A forming box according to claim 3, wherein the belt screen is driven with a constant speed.

5. A forming box according to claim 1, wherein the belt screen is intermittently driven.

6. A forming box according to claim 1 including fiber separating rollers in a row below the upper run of the belt screen and positioned with a decreasing distance between their axis of rotation and the belt screen in the direction of travel of the upper run of the belt screen.

7. A forming box according to claim 1, further comprising two rows of spike rollers provided on each side of the upper run of the belt screen.

8. A forming box according to claim 1, wherein two rows of rollers are provided on each side of the lower run of the belt screen.

9. A forming box according to claim 1, wherein fiber separating rollers are provided along at least one of the vertical runs of the belt screen.

10. A forming box according to claim 1, wherein the belt screen extends beyond the housing in the downstream direction with respect to the traveling direction of the forming wire.

11. A forming box according to claim 1, wherein the belt screen is provided entirely inside the housing.

12. A forming box according to claim 1, wherein the belt screen is provided with grid openings in a predetermined pattern.

13. A forming box according to claim 1, wherein the belt screen is a wire mesh having a predetermined mesh opening.

14. A forming box according to claim 1, wherein the belt screen has transversely orientated grid members with openings in between.

15. A forming box according to claim 1, wherein the lower run of the belt screen is immediately above the forming wire so that the belt screen makes contact with the upper side of the fiber formation being air laid on the forming wire.

16. A forming box according to claim 1, wherein the forming box is provided with a bottom sieve and the belt screen is positioned such that its lower run is immediately above and parallel to said sieve, and the belt screen is provided with sieve cleaning means.

17. A forming box according to claim 1, wherein a separate material inlet is provided above the fiber inlet for reception of a granulate material or a second type of fiber material to be mixed with the fibers supplied through the fiber inlet.

18. A method for the dry forming of a mat of fibrous material, comprising e steps of:

charging fibrous material into a forming box having an open bottom positioned over a forming wire to form a mat of fibers on the forming wire, the forming box having a plurality of fiber separating rollers for breaking apart clumps of fibers;

capturing clumps of fibers on a lower run of an endless belt screen beneath fiber separating rollers and above the forming wire; and conveying captured clumps of fibers on the endless belt screen above fiber separating rollers in an upper run to enable the captured clumps to release from the belt and to contact and be broken apart by the rollers.

19. A method according to claim 18, wherein the endless belt screen comprises a plurality of mechanical links having adjustable openings between them, the method including the steps of narrowing the openings of the lower run and widening the openings of the upper run.

20. A method according to claim 18, including the step of bringing the endless belt screen into contact with an upper surface of the fibrous mat as the mat is formed.

21. A method according to claim 18, including the step of cleaning the belt screen of fibrous material.

22. A method according to claim 18, including the step of leading the endless belt screen out of and into the forming box.

23. A method according to claim 22, including the step of cleaning the belt of fibrous material when the belt screen is outside of the forming box.

24. A method according to claim 18, including the step of moving the forming wire and the lower run of the endless belt screen in the same direction.

25. A method according to claim 18, wherein the forming box includes a row of fiber separating rollers having rotational axes and positioned beneath the upper run of the endless belt, the method including the step of decreasing the distance between the roller axes and the upper run in the direction of travel of the upper run.

26. A method according to claim 18, wherein a separate material inlet is provided above the fiber inlet, the method including the step of supplying a granulate material or a second type of fiber material through the separate material inlet, so that this second material supply is mixed with the fibers supplied through the fiber inlet.

27. A method according to claim 26, where the supplied granulate is one or more of vermiculite, rubber, plastic, glass fiber, and rock wool.

28. A method according to claim 26, where the supplied granulate is a metallic granulate or metallic fiber.

* * * * *